US007713605B2

(12) United States Patent
Yousif et al.

(10) Patent No.: US 7,713,605 B2
(45) **Date of Patent: *May 11, 2010**

(54) CONTAINER SEAL WITH INTEGRAL, HEAT-RELEASABLE PROMOTIONAL TOKEN AND METHOD

(75) Inventors: Paul E. Yousif, Wheaton, IL (US); Sue A. Ross, Elmhurst, IL (US); George Antar, Morton Grove, IL (US); Bahjat Z. Yousif, Elmhurst, IL (US)

(73) Assignee: Tech-Seal Products, Inc., Schaumburg, IL (US)

( * ) Notice: Subject to any disclaimer, the term of this patent is extended or adjusted under 35 U.S.C. 154(b) by 1253 days.

This patent is subject to a terminal disclaimer.

(21) Appl. No.: 11/008,495

(22) Filed: Dec. 9, 2004

(65) Prior Publication Data

US 2006/0124574 A1 Jun. 15, 2006

(51) Int. Cl.
*B32B 9/00* (2006.01)
*B32B 9/06* (2006.01)

(52) U.S. Cl. ..... 428/40.1; 428/40.5; 428/486; 428/487

(58) Field of Classification Search ..... 428/40.1, 428/40.5, 486, 487
See application file for complete search history.

(56) References Cited

U.S. PATENT DOCUMENTS

| | | | |
|---|---|---|---|
| 3,968,823 | A | 7/1976 | Simon |
| 4,013,188 | A | 3/1977 | Ray |
| 4,280,653 | A | 7/1981 | Elias |
| 4,588,099 | A | 5/1986 | Diez |
| 4,596,338 | A | 6/1986 | Yousif |
| 4,666,052 | A | 5/1987 | Ou-Yang |
| 4,684,554 | A | 8/1987 | Ou-Yang |
| 4,767,654 | A | 8/1988 | Riggsbee |
| 4,778,698 | A | 10/1988 | Ou-Yang |
| 4,784,885 | A | 11/1988 | Carespodi |
| 4,861,644 | A | 8/1989 | Young et al. |
| 4,934,544 | A | 6/1990 | Han |
| 4,960,216 | A | 10/1990 | Giles |
| 5,004,111 | A | 4/1991 | McCarthy |
| 5,012,946 | A | 5/1991 | McCarthy |
| 5,019,436 | A | 5/1991 | Schramer et al. |
| 5,106,124 | A | 4/1992 | Volkman et al. |

(Continued)

OTHER PUBLICATIONS

U.S. Appl. No. 11/008,485, unpublished, Yousif, et al.

(Continued)

*Primary Examiner*—Victor S Chang
(74) *Attorney, Agent, or Firm*—Olson & Cepuritis, Ltd.

(57) ABSTRACT

A heat-sealable container seal having a integral, heat-releasable promotional token attached thereto comprises a promotional token bound to a sealant sheet by a layer of wax. At least one of the surfaces of the promotional token and the sealant sheet that contacts the layer of wax is capable of absorbing liquid wax when the layer of wax is melted. At least one surface of the promotional token has promotional indicia visible thereon. The sealant sheet has a heat-sealable container contacting surface. Preferably, at least one of the promotional token and the sealant sheet includes a layer of metal foil. In use, the container seal provides a seal over the access opening of a container and also provides a promotional token, such as a redeemable coupon, within the container closure, loosely disposed over the seal.

19 Claims, 2 Drawing Sheets

U.S. PATENT DOCUMENTS

| | | | |
|---|---|---|---|
| 5,197,618 | A | 3/1993 | Goth |
| 5,356,021 | A | 10/1994 | McBride et al. |
| 5,372,268 | A | 12/1994 | Han |
| 5,381,913 | A | 1/1995 | Peeters |
| 5,712,042 | A | 1/1998 | Cain |
| 5,813,563 | A | 9/1998 | Boehm et al. |
| 5,915,585 | A | 6/1999 | Ladina et al. |
| 6,032,820 | A | 3/2000 | Ladina et al. |
| 6,047,488 | A | 4/2000 | Tuszkiewicz |
| 6,082,566 | A | 7/2000 | Yousif et al. |
| 6,131,754 | A | 10/2000 | Smelko |
| 6,174,274 | B1 | 1/2001 | Hawkins et al. |
| 6,237,843 | B1 | 5/2001 | Falat et al. |
| 6,327,801 | B1 | 12/2001 | Witkowski et al. |
| 6,374,726 | B1 | 4/2002 | Melton |
| 6,670,009 | B1 | 12/2003 | Voss |
| 6,709,726 | B1 | 3/2004 | Dronzek et al. |
| 6,746,743 | B2 | 6/2004 | Knoerzer et al. |

OTHER PUBLICATIONS

U.S. Appl. No. 11/007,874, unpublished, Ross, et al.

CONTAINER SEAL WITH INTEGRAL, HEAT-RELEASABLE PROMOTIONAL TOKEN AND METHOD

FIELD OF THE INVENTION

The invention relates to improved container sealing materials and methods. More particularly, the invention relates to improved container seals having a heat-releasable promotional token as an integral portion thereof. The invention also relates to containers sealed with the improved container seals and to a method of providing a promotional token within a container closure.

BACKGROUND OF THE INVENTION

It is common practice to seal a container with a sheet material, such as paper, a polymeric film, aluminum foil, or a laminate of paper, polymeric film and/or aluminum foil. The use of such seals, in many cases, has been imposed on the packaging industry by FDA regulations, as a protection against product tampering. Such seals provide evidence of product tampering, since they are typically destroyed by the process of removing the seal. It is also common to line the inner surface of container closures with a moderately compressible material, such as a polymeric material, pulp board, or a multilayer laminated combination thereof. When a closure containing the liner material is secured to the finish of a container, such as by applying a torque force to a threaded closure that is engaged with a threaded container finish, the resulting pressure exerted by the closure onto the liner, which is interposed between the closure and the container finish, produces a substantially liquid and/or gas-tight seal. When the closure is removed from the container, the liner remains within the closure. Re-engaging the closure with the container finish re-establishes the seal. Liner materials can utilize a pulp or paper substrate or polymeric materials, such as polyolefin foams or laminated multilayer lining materials comprising a combination of pulp or a polymeric foam along with a polymeric film, metal foil, and the like.

In a typical application, closures for containers are lined with a laminated material having a layer of pulp mounted to a layer of aluminum foil by an intermediate wax layer. Such laminated materials also frequently contain a layer of polymer, such as a polyester film, fixed by an adhesive to the foil, and a layer of sealing material fixed by an adhesive to the polyester film. The laminate is produced and shipped in roll form, which is then cut to the required shape and size, and mounted in a closure with an adhesive or by friction.

In use, the resulting lined closure is torqued onto a container, such as a bottle or jar, which has been filled with a fluid or solid product. Next, the capped container is passed through a high frequency induction heating unit. During induction heating, the aluminum foil is heated to a temperature in excess of about 65° C., generally about 150° C. or greater, which melts the wax in the layer between the pulp and aluminum foil. The melted wax is absorbed by the pulp, causing the pulp to separate from the remainder of the material. The sealing material typically is selected to match the material of construction of the container, and is heat-welded or sealed to the rim of the container (i.e.., the container finish) during induction heating. When a consumer removes the closure from the container, the pulp layer remains in the closure as a liner, leaving the foil, polymer film, and sealing material on the container as an inner seal, to provide evidence of tampering and to prevent leakage and contamination of the container contents during storage and shipment.

A clear, transparent seal is often desirable so that the contents of the container can be viewed through the seal, particularly when an opaque container is used. In some applications, it is also desirable to have a liner with a non-absorbent surface in direct contact with the contents of the container, rather than a paper layer. Such applications include, for example, when the contents of the container includes volatile materials or liquid substances that can be absorbed by the paper.

Modem advertizing and packaging often makes use of promotional materials, such as coupons, sweepstakes, games, and the like, to promote products and services. In many cases, this requires placing the coupon or other promotional material on the exterior of the container, where it is easily removed by individuals who did not purchase the product. This has led some to place coupons inside the product container. When the product is a food or drug item, any coupon that contacts the contents of the container must be printed with an FDA approved ink, or must be sealed in a hermetic pouch, both of which add to the expense of the promotional materials. It would be very useful to be able to place a readily retrievable coupon or other promotional material within a container closure. Some specialized closures have been developed, which have chambers for sealing promotional materials inside the closure itself; however, such specialized closures are expensive and can be complicated to manufacture. Accordingly, there is an ongoing need for ways to conveniently include promotional materials, such as a coupon, within a container closure. There is also an ongoing need for improved container sealing materials that provide functional features such as tamper evidence, preservation of product quality, packaging integrity, and the like.

The present invention provides promotional materials integrated with a container seal, so that the promotional material can be included within the container closure and not in contact with the contents of the container. While container seals are a regulatory requirement for many food and drug applications, the container seals of the present invention turn this regulatory requirement into a marketing asset by integrating useful promotional materials into the container seal. The container seals of the present invention can be used with standard, conventional closures to provide promotional materials such as a coupon within the closure, without need for expensive specialty closures.

SUMMARY OF THE INVENTION

A container seal having a heat-releasable, integrated promotional token comprises a sealant sheet releasably bound to a promotional token. The sealant sheet has a tacking surface and a sealing surface. The sealing surface of the sealant sheet comprises a heat-sealable polymeric film. The promotional token has a tacking surface and an obverse surface. At least one surface of the promotional token has promotional indicia visible thereon. At least one of the tacking surface of the promotional token and the tacking surface of the sealant sheet comprises a wax-absorbent material. The tacking surface of the promotional token is bound to the tacking surface of the sealant sheet by a layer of wax, so that the promotional token releases from the sealant sheet when the layer of wax is melted. Preferably, at least one of the promotional token and the sealant sheet includes a layer of metal foil, such as aluminum foil.

The promotional token and the sealant sheet each independently can be a single layer of material, or a multilayer structure.

A sealed container of the present invention comprises a container having an access opening surrounded by a container finish, a sealant sheet bound to the finish of the container over the access opening, sealing the container, and a closure over the container seal engaged with the container finish. At least one surface of the promotional token of the container seal has promotional indicia, such as a coupon, visible thereon. The promotional token is loose and disposed between the closure and the sealant sheet. The promotional token is removable by a consumer when the closure is removed from the container. When a consumer removes the closure from the container, the promotional token is readily retrieved by the consumer.

A method of providing a promotional token within the closure of a container comprises heat-bonding the sealant sheet of a container seal of the invention to the finish and over the access opening of a container. The sealant sheet provides a seal (e.g., a tamper-evident seal) over the access opening of the container and the promotional token is retrievable by a consumer without breaking the seal. The promotional token is covered by a closure secured over the finish of the container until a consumer removes the closure.

DETAILED DESCRIPTION OF PREFERRED EMBODIMENTS

Figure 1:
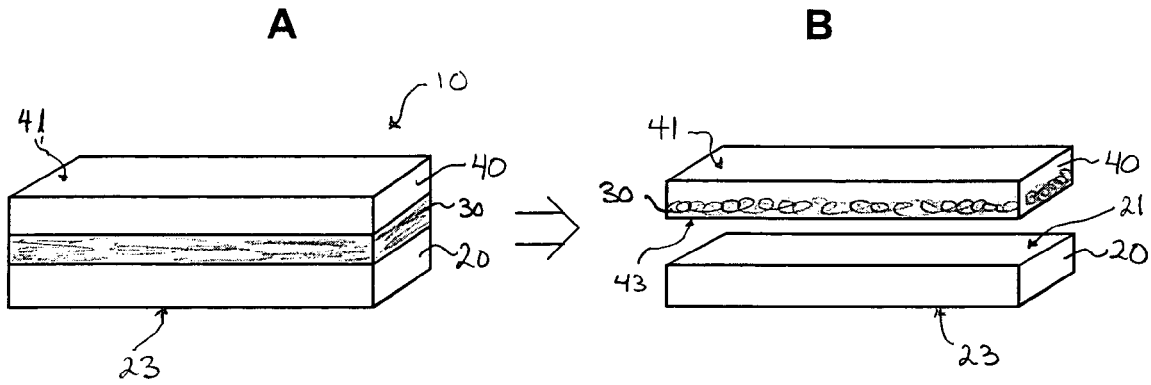
FIG. 1 is a schematic diagram of a container seal of the present invention. Panel A illustrates a promotional token 40 bound to a sealant sheet by layer of wax. Panel B illustrates separation of promotional token 40 from sealant sheet 20 when layer of wax 30 is melted and absorbed by the promotional token or the sealant sheet.

As used herein, the term "closure" and grammatical variations thereof, refers to a lid or cap, such as a threaded cap, a lug-type cap, a snap-cap, and the like, that is designed to be repeatedly secured to and removed from a container finish, such that when the cap or lid is secured to the container finish, a seal is formed that protects the contents of the container from contamination and leakage.

The terms "lining material" and "liner" refer to a sheet material that is compressible and preferably semi-rigid, and is suitable for use within a closure to provide a resealable seal between the closure and a container finish. The term "liner" also refers to a section of lining material that has been cut to fit snugly within a closure against the upper inside surface thereof.

The term "seal" refers to a film or multilayer laminate material that is fixedly secured onto the finish of a container over the access opening of the container to provide air and/or fluid tight seal. To access the contents of the container, the seal must be broken. A seal can provide evidence of product tampering, for example, when removal of the seal leaves a residue on the finish of the container. A container is typically is fitted with a closure over a container seal. The closure protects the integrity of the seal during shipping and storage.

The term "promotional token" as used herein and in the appended claims, refers to a sheet material that includes information promoting a product, a service, a game (e.g., a contest or sweepstakes), a company, an organization, a cause, and the like (i.e.., promotional indicia). The promotional indicia are visible on one or both surfaces of the material.

The term "wax", as used herein and in the appended claims is not limited to natural waxes and parafins, but also encompasses materials commonly referred to as waxes in the packaging and converting industries, such as microcrystalline wax, polyethylene wax, polyisobutylene resins, and so-called synthetic waxes, such as amide waxes, amide waxes, as well as mixtures thereof.

A container seal having a heat-releasable, integrated promotional token comprises a sealant sheet releasably bound to a promotional token. The sealant sheet has a tacking surface and a sealing surface. The promotional token has a tacking surface and an obverse surface. At least one surface of the promotional token has promotional indicia visible thereon. The tacking surface of the promotional token is bound to the tacking surface of the sealant sheet by a layer of wax. At least one surface in contact with the layer of wax comprises a wax-absorbent material, so that the promotional token releases from the sealant sheet when the layer of wax is melted.

The sealant sheet and the promotional token can each comprise one or more layers of material, such as cellulose pulp, paper, a synthetic fabric, a polymer film, a polymer foam, a metal foil, and the like, or any combination thereof. Preferably, at least one of the sealant sheet and the promotional token includes a layer of metal foil, such as aluminum foil. The sealing surface of the sealant sheet comprises a heat-sealable polymer film for heat-bonding to a container finish.

A sealed container of the present invention comprises a container having an access opening surrounded by a container finish, a sealant sheet bound over the container finish, a promotional token disposed over the sealant sheet, and a closure covering the promotional token and engaged with the container finish. The sealant sheet has a tacking surface and a sealing surface. The sealing surface of the sealant sheet is bound to the container finish over the access opening, forming a seal (e.g., a tamper-evident seal). The promotional token has a tacking surface and an obverse surface. At least one surface of the promotional token has promotional indicia visible thereon. The tacking surface of the promotional token is bound to the tacking surface of the sealant sheet by a layer of wax. The tacking surface of the promotional token or the tacking surface of the sealant sheet, or both, comprises a wax-absorbent material, such as paper or a synthetic fabric. The promotional token releases from the sealant sheet when the wax layer melts and is absorbed by the wax-absorbent material.

A method of providing a promotional token within a container closure comprises securing a closure over a container finish, the closure including a container seal of the invention, and bonding the sealing surface of the container seal to the finish and over the access opening of a container. The container seal provides a seal over the access opening and the promotional token is retrievable by a consumer when the closure is removed.

Referring now to the Drawings, wherein similar reference-numbers refer to correspondingly similar components, FIG. 1 schematically illustrates container seal 10 of the present invention. Panel A shows promotional token 40 bound to sealant sheet 20 by a layer of wax 30. In one embodiment, promotional token 40 comprises a layer of wax-absorbent material, such as a layer of paper, which is capable of absorbing melted wax, and sealant sheet 20 comprises a heat-sealable polymer film. Panel B illustrates separation and release of promotional token 40 from sealant sheet 20 when layer of wax 30 is melted and absorbed by absorbent tacking surface 43 of promotional token 40. In other embodiments, sealant sheet 20 includes a wax-absorbent material at its tacking surface 21 and a heat-sealable polymer film at its sealing surface 23.

Figure 2:
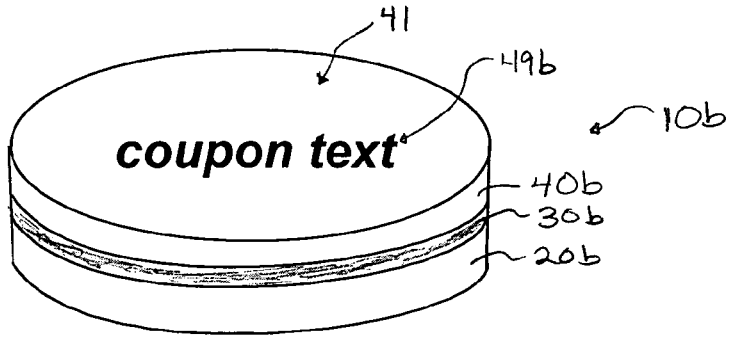
FIG. 2 illustrates a container seal of the invention, having a coupon visible on a surface of the promotional token.

FIG. 2 illustrates container seal 10*b* in perspective view, showing coupon 49*b* visible on obverse surface 41*b* of promotional token 40*b*. Coupon 49*b* can be printed directly on obverse surface 41*b* or can be printed below surface 41*b* if obverse surface 41*b* is transparent.

Figure 3:
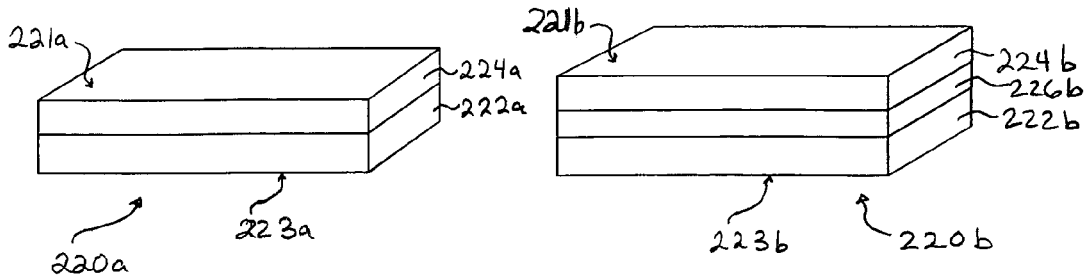
FIG. 3 illustrates two forms of sealant sheet useful in the container seals of the invention. Panel A shows a two-layer sealant sheet and Panel B shows a three-layer sealant sheet.

Two embodiments of a sealant sheet (220*a* and 220*b*) are shown in FIG. 3. Panel A illustrates a two-layer sealant sheet having a tacking surface 221*a* and a sealing surface 223*a*. Sealant sheet 220*a* comprises a facing layer 224*a* and sealing layer 222*a* bonded thereto. Facing layer 224*a* can comprise a polymeric foam, a polymer film (e.g., a barrier film), a metal foil, or a layer of wax-absorbent material, such as paper or a synthetic fabric. Sealing layer 222*a* comprises a heat-sealable polymer film. Panel B illustrates a three-layer sealant sheet 220*b*. Sealant sheet 220*b* has a tacking surface 221*b* and a sealing surface 223*b*. Sealant sheet 220*b* comprises facing layer 224*b* and sealing layer 222*b* with a core layer 226*b* bound therebetween. Facing layer 224*b* and core layer 226*b* each independently can comprise any of the materials as described above for facing layer 224*a*. Sealing layer 222*b* is a heat-sealable polymeric film. In one form of sealant sheet 220*a*, facing layer 224*a* is a polymeric barrier film.

Figure 4:
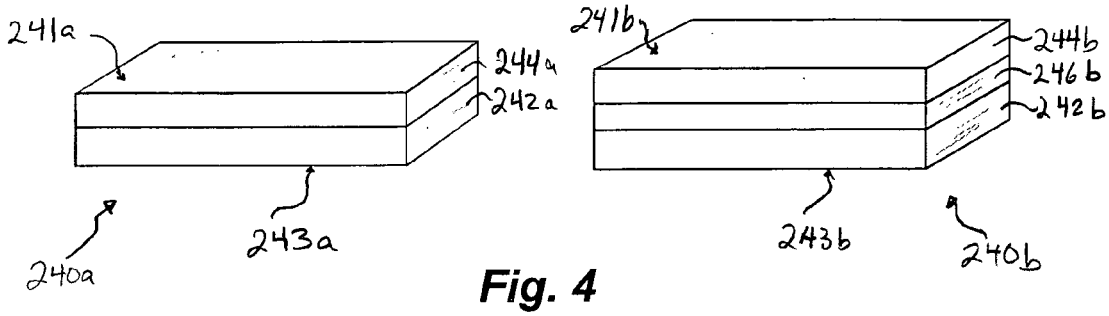
FIG. 4 illustrates two forms of promotional token useful in the container seals of the invention. Panel A shows a two-layer promotional token and Panel B shows a three-layer promotional token.

Two embodiments of a promotional token (240*a* and 240*b*) are shown in FIG. 4. Panel A shows a two-layer promotional token having an obverse surface 241*a* and a tacking surface 243*a*. Promotional token 240*a* comprises a first facing layer 242*a* and second facing layer 244*a* bonded thereto. Facing layers 242*a* and 244*a* each independently can comprise a polymeric foam, a polymer film, a metal foil, or a layer of wax-absorbent material, such as paper or a synthetic fabric. At least one of obverse surface 241*a* and tacking surface 243*a* of promotional token 240*a* includes promotional indicia, such as a redeemable coupon, a game token, a proof-of-purchase indicator, and the like, visible thereon. Panel B illustrates a three-layer promotional token 240*b*. Promotional token 240*b* has an obverse surface 241*b* and a tacking surface 243*b*. Promotional token 240*b* comprises first and second facing layers 242*b* and 244*b*, respectively, with a core layer 246*b* bound therebetween. First and second facing layers 242*b* and 244*b* and core layer 246*b* each independently can comprise any of the materials as described above for facing layers 242*a* and 244*a*. At least one of obverse surface 241*b* and tacking surface 243*b* of promotional token 240*b* includes promotional indicia visible thereon.

Figure 5:
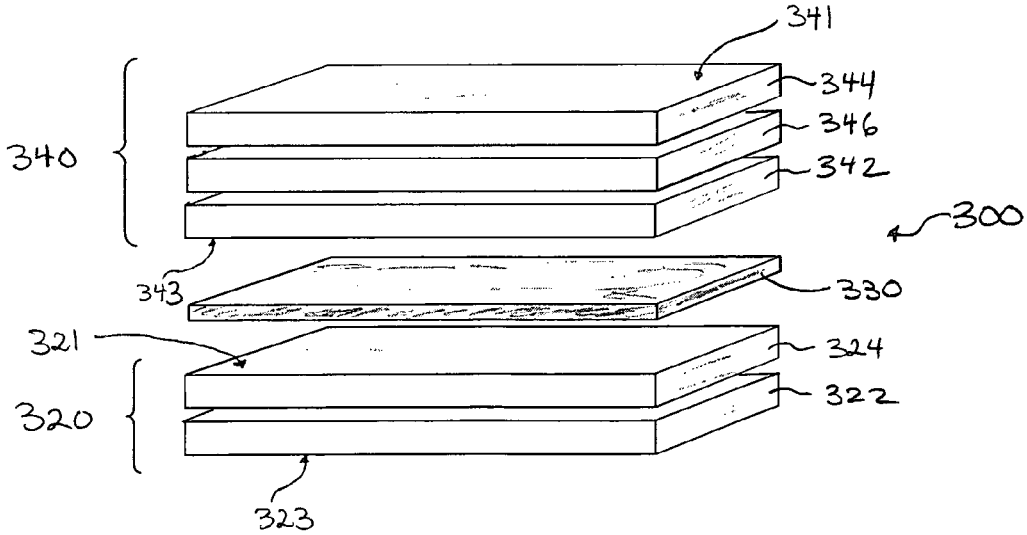
FIG. 5 illustrates a preferred embodiment of a container seal of the invention.

FIG. 5 illustrates a preferred container seal of the present invention. Container seal 300 comprises promotional token 340 bound to sealant sheet 320 by layer of wax 330. Promotional token 340 comprises facing layer 344, which can be a layer of paper or a layer of synthetic fabric. Facing layer 344 is adhesively bound to a sheet of aluminum foil 346, which is also adhesively bound to a second facing layer 342, which also can be a layer of paper or synthetic fabric. Sealant sheet 320 comprises a barrier film 324 adhesively bound to a heat-sealable polymer film 322. Sealant sheet 320 is bound to promotional token 340 by a layer of wax between second facing layer 342 and barrier film 324. Promotional indicia, such as a coupon or game token are printed on at least one of surface 341 and surface 343 of promotional token 340.

The container seals of the present invention can include any combination of single-layer or multilayer sealant sheet and promotional token as described above. Multilayer sealant sheets and promotional tokens preferably are two-layer, three-layer, four-layer or five-layer structures. Multilayer structures generally comprise sheets of cellulose pulp, paper, synthetic fabric, polymer film, polymer foam, metal foil, and the like, or any combination thereof, adhesively bonded together or thermally fused together to form a unitary structure, as is well known in the materials converting and laminating arts.

In one illustrative use, a container seal of the invention can be die-cut to an appropriate size and shape and conveniently placed within a container closure (e.g., a cap) as a single unit. The container seal is sized to fit securely within the closure and is placed in the closure with the obverse surface of the promotional token facing inward and contacting the inside top of the closure. The closure is then secured to the finish of a container (e.g., a bottle or a jar), for example, by torquing a threaded closure onto a threaded finish of a container after the container has been filled with a product.

Heat is applied to the container seal to bond the sealing surface to the container finish. Heat can be applied to the container seal inductively if at least one of the promotional token or sealant sheet includes a metal foil layer, or if the closure is metal, for example. In the inductive heating process, the container is passed through an induction-sealing device in which radio frequency (rf) energy inductively heats the metal foil (or closure), preferably to a temperature in the range of about 65 to about 150° C. The heat also liquefies the layer of wax that tacks the promotional token to the sealant sheet. The wax is then absorbed by a wax-absorbent material in contact with the wax layer, causing the promotional token to release and separate from the sealant sheet. The wax layer that binds the liner to the promotional token preferably is selected to have a melting point in the range of about 65 to about 150° C.

Upon removal of the closure by a consumer, the promotional token remains loosely disposed over the sealant sheet, while the sealant sheet remains bound to the finish of the container as a protective seal. The promotional token is retrievable by a consumer when the closure is removed.

Polymeric foams useful in the container seals of the present invention can be secured to other layers of material, such as a metal foil, paper, synthetic fabric, or polymer film, by lamination or by extruding the foam directly onto a web of the other material. Methods of extruding polymeric foams are well known in the polymer art. For example, methods of producing polymeric foams are described in A. Brent Strong, *Plastics Materials and Processing*, 2$^{nd}$ Ed., Prentice Hall Inc., Upper Saddle River, N.J., Chapter 17, pp. 589-614 (2000), the disclosure of which is incorporated herein by reference. The polymeric foams can be manufactured using any known foaming process, e.g. by mechanical foaming, chemical foaming, physical foaming, and the like. Preferably, the polymeric foam is formed by chemical foaming with a blowing agent. Blowing agents are well known in the polymer arts.

Suitable blowing agents include the following chemicals designated by the U.S. Environmental Protection Agency as suitable replacements for chlorofluorocarbons (CFC's) and hydrochlorofluorocarbons (HCFCs) for use as blowing agents in polyolefin foams:

Methylene chloride (dichloromethane);

1,1,1,2-tetrafluoroethane (HFC-134a);

1,1,-difluoroethane (HFC-152a);

1,1,1-trifluoro 2,2-dichloroethane (HCFC-123);

1,1,1-trifluoroethane (HFC-143a);

1,1,1,3,3-pentafluoropropane (HFC-245fa);

saturated light hydrocarbons ($C_3$-$C_6$ hydrocarbons);

water; and carbon dioxide.

Other suitable blowing agents include chemical blowing agents such as carbonate and azo type compounds. Such compounds include, without being limited thereto, ammonium carbonate, ammonium bicarbonate, potassium bicarbonate, sodium bicarbonate, diazoaminobenzene, diazoaminotoluene, azodicarbonamide, diazoisobutyronitrile, and the like.

Metal foils useful in the container seals of the present invention can comprise any metal that is suitable for use in a closure liner or container seal. Choice of a particular metal will depend on the nature of the material to be included in the container to be sealed by the container seal of the invention, although aluminum foil is the most common conventional metal foil used for induction sealing purposes, and is particularly preferred. Preferably, the metal foil is aluminum foil having a thickness in the range of about 1 mil to about 2 mils.

Materials suitable for use as a polymer film in the container seals of the invention include, for example, polyolefins such as polyethylene or polypropylene, polyesters such as PET, functionalized polyolefins such as ethylene vinyl alcohol (EVOH) or ethylene vinyl acetate (EVA) polymers, halogenated polyolefins such as polyvinyl chloride (PVC) or polyvinylidene chloride (PVdC), acrylonitrile methacrylate copolymer films (e.g., BAREX® film, BP Chemicals, Inc., Cleveland, Ohio), and the like. The polymer film can be a single layer of polymer, or a multilayer structure comprising two or more layers of polymer bound together. A particularly preferred polymer film is a medium density polyethylene film (MDPE). Preferably, the polymer film has a thickness in the range of about 0.5 to about 2 mils.

Adhesives suitable for permanently securing various layers of the container seals of the invention to one another include epoxy adhesives, solvent-based cements containing synthetic rubber or a phenolic resin, acrylic adhesives, urethane adhesives, or any other suitable adhesive, or a tie-layer. Tie-layers are often used to provide adhesion between a nonpolar polymer, such as polyethylene, and a polar polymer such as ethylene vinyl alcohol (EVOH). Typically, tie-layers are functionalized polyolefins such as ethylene acrylic acid copolymers, ethylene vinyl acetate copolymers (EVA), and the like, as is well known in the art.

One preferred form of adhesive is a solventless adhesive system, such as MOR-FREE® 403A/C117, available from Rohm & Haas Corp., Springhouse, Pa.). An other preferred adhesive is the two part adhesive available under the trade name ADCOTE® 503 adhesive, from Rohm & Haas Corp, which is epoxy resin used in combination with a curing agent such as Coreactant F, also available from Rohm & Haas Corp. Other preferred adhesives include solventless adhesive systems, which are also available from Rohm & Haas, for example. Examples of useful adhesives are disclosed in Arthur H. Landrock, *Adhesives Technology Handbook*, Noyes Publications, Park Ridge, N.J., (1985), incorporated herein by reference.

If an adhesive is utilized, a polymeric foam and/or a polymeric film can be surface-treated to improve adhesion. Suitable surface treatments include, without being limited to, chromic acid etching, corona treatment, oxidizing flame treatment, gas plasma treatment, and the like.

The wax-absorbent materials useful in the present invention can be a paper, cellulose pulp (e.g., pulp board), or an absorbent synthetic fabric such as a nonwoven fabric, an absorbent polymeric foam, a porous polymeric film, and the like. The wax-absorbent material can be can be a single layer of absorbent material, or a multilayer structure comprising two or more layers of absorbent material bound together (e.g., by an adhesive). In any event, the wax-absorbent material is selected to be capable of absorbing a sufficient quantity of the wax to cause the liner to release from the promotional token.

The thickness of a wax-absorbent material is selected so that the material will absorb a sufficient amount of a wax layer to allow the promotional token to release from the sealant sheet when the wax is melted. Preferably, the wax-absorbent material has a thickness in the range of about 1 mil to about 12 mils, more preferably about 2 mils to about 10 mils, and most preferably about 2.5 mils to about 6 mils.

Paper, cellulose pulp, and synthetic fabric materials can be used as components of the container seals of the invention even in a layer that is not in contact with wax.

Suitable paper and cellulose pulp materials for use in the container seals of the invention include bleached or unbleached Kraft paper, single-layer or multilayer glassine paper, bleached or unbleached cellulose pulp, clay-coated papers, or any other paper or cellulose sheet material commonly used in container seals or liners in the packaging industry.

Synthetic fabrics that are useful in the container seals of the invention include nonwoven polyolefin fabrics and nonwoven polyester fabrics. Suitable nonwoven polyolefin fabrics include nonwoven polyethylene materials, such as a microporous polyethylene film or spunbonded high density polyethylene, as well as nonwoven polypropylene, nonwoven ethylene-propylene copolymer, and nonwoven blends thereof. Suitable nonwoven polyester fabrics include nonwoven polyethylene terephthalate fabrics and spunlaced DACRON® polyester-based fabrics available from E.I. DuPont de Nemours & Co., Inc. of Wilmington, Del. (DuPont), under the trade name SONTARA®. Preferably, the synthetic fabric is an absorbent polyethylene non-woven fabric such as TYVEK® non-woven fabric, available from DuPont, or a microporous polyethylene film sold under the trade name TESLIN® by PPG Industries, Inc., Pittsburgh, Pa.

A wax layer for tacking the promotional token to the sealant sheet preferably comprise paraffin, a microcrystalline wax, a polyethylene wax, a polyisobutylene resin, a butyl rubber resin, a synthetic wax, such as a polyamide wax (e.g., a stearamide, an oleamide, or erucamide), or a mixture thereof. More preferably, the wax layer comprises paraffin, a microcrystalline wax, or a combination thereof. Most preferably the wax layer comprises a microcrystalline wax. A wax layer, when present preferably has a melting point in the range of about 65 to about 150° C. Preferably, a wax layer has a thickness of about 0.2 to about 2 mils, more preferably about 0.5 to about 0.75 mils.

A barrier film, when present, preferably comprises a polymeric material having oxygen barrier, moisture barrier, solvent barrier, or toughness (i.e., puncture resistance) properties, as desired, based on the type of contents that will be included within a container sealed by the container seal of the invention. The barrier film can be a single layer of polymer, or a multilayer structure comprising two or more layers of polymer either directly bound to one another or adhesively secured to each other. Non-limiting examples of materials that can be used as a moisture barrier film include vinyl chloride/vinylidene chloride copolymer (i.e.., PVC-PVdC) films marketed by Dow Chemical Company under the trademark SARAN®, polyethylene, oriented polypropylene (OPP), OPP/polyvinyl chloride (PVC) laminates, and OPP/PVC-PVdC laminates. Non-limiting examples of materials that can be used as an oxygen barrier film include PVC-PVdC, PET, PVC-PVdC/PET laminates, acrylonitrile methacrylate copolymer films, PVdC, and OPP/PVC-PVdC laminates. Non-limiting examples of solvent resistant films include PET and polyethylene. Non-limiting examples of puncture resistant films include PET and PVC. Preferred barrier films are PET, PVdC, and acrylonitrile methacrylate copolymer films. Preferably the barrier film has a thickness in the range of about 0.5 to about 3 mils.

The heat-sealable film is a thermoplastic material that will soften and bond to a container finish with which it is in contact when heated at temperatures achieved during typical induction or conduction sealing operations, under the pressure exerted by the closure on the container seal between the closure and the container finish. Typically the pressure on the container seal is achieved by torquing a threaded closure including the container seal onto a threaded container finish with a torque in the range of about 15 inch-pounds to about 90 inch-pounds. Examples of materials that can be used as a heat-sealable film include low-density polyethylene, medium density polyethylene, polypropylene, ethylene vinyl acetate (EVA), ionomer films, and amorphous PET. Typically, the heat-sealable film is selected to be of the same material as the container finish or of a material that is compatible with the container finish. Accordingly, a polyethylene film would be selected as a heat-sealable film to seal a high-density polyethylene container finish. Similarly, a PET film can be used as the heat-sealable film to seal a PET container finish. If it is desired that the sealant sheet be relatively easy to puncture by the consumer, a biaxially oriented thermoplastic material would be selected as the heat-sealable film. Preferably, the heat sealable film is medium density polyethylene, polypropylene, EVA copolymer, or PET. When a relatively strong, puncture-resistant sealant sheet is desired, a tough barrier film can be included over the heat-sealable film.

The selection of appropriate shape and dimensions for an container seal to be used with a particular closure and container combination is routine for one of ordinary skill in the packaging art. Typically, the dimensions of the container seal are chosen to be substantially equal to the inside dimensions of the upper surface of the closure, so that the upper surface of the container seal will fit snugly within closure. The thickness of the container seal is selected based on the clearance between the upper inside surface of the closure and the finish of a complementary container. Preferably, the thickness of the container seal is selected so that the container seal is slightly compressed when the material is sealed between the closure and a container finish. Such compression aids in forming a fluid and/or air-tight seal. Container closures are selected to match container finishes of complementary dimensions and design, as is well known in the packaging art.

The container seals of the present invention can be manufactured using standard coating and lamination techniques that are well known in the art. For example, a heat-sealable polymer and a barrier film can be laminated to foil using one or more conventional adhesive to form a sealant sheet. The barrier film of the sealant sheet can then be laminated to the tacking surface of a paper sheet by a layer of wax. The paper sheet can have a coupon or other promotional indicia printed in-register on at least one surface.

Preferably, the container seal of the invention has an overall thickness in the range of about 1 to about 20 mils, more preferably about 2 to about 10 mils. Preferably, the sealant sheet portion has a total thickness in the range of about 0.5 to about 3 mils, more preferably about 0.5 to about 2 mils.

The container seals of the present invention can be manufactured to full machine width in a master roll form, utilizing standard roll coating and laminating equipment that is well known in the coating and laminating arts. Typically, the master roll of sheet material is slit to a desired width and shipped to a closure manufacturer. The closure manufacturer, in turn, die-cuts the slit master roll to the desired size and shape for use in particular container closures. The die-cut container seals are then inserted or pressed into the closure and sealed to a filled container as described above. Die-cutting is performed in-register with the promotional indicia present on the promotional token portion of the material.

Any common closure design suitable for use with a liner or tamper evident seal can be used in conjunction with the container seals of the present invention. Preferred closures include standard, continuous threaded (CT) closures, which are well known in the art. Such closures are described, for example J. L. Heid and Maynard A. Joslyn, Eds. *Fundamentals of Food Processing Operations Ingredients, Methods, and Packaging*, The AVI Publishing Company, Inc., Westport, Conn. (1967), pp. 649-655.

It is currently difficult to provide a useful promotional indicia, such as a coupon or proof-of-purchase indicator within a container closure. The container seals of the present invention provide an integrated tamper-evident seal and separable promotional token. The container seals of the invention afford a convenient solution to the problem of providing promotional materials for a product, service, contest, and the like, under a container closure. The promotional indicia visible on the surface of the promotional token can include words, symbols, logos, bar codes, holographic images, art work, or any other information desired by the packager, product manufacturer, or retailer. The present invention advantageously provides a freely removable promotional token for use by a consumer when a container closure is removed by a consumer. The promotional token can be manufactured by printing, in register, the promotional indicia onto a master roll or a slit roll of container seal material or imprinting such indicia onto a component material prior to assembling the container seal. Sections of container seal for use in a closure can be cut from a master roll in register with the printed material on the roll, using equipment and methods that are well known in the art.

It is preferred that the promotional token include printed promotional indicia promoting a product, a service, a contest, or a game, a company, an organization a cause, and the like, visible on one or both of its surfaces or on a layer subjacent to a surface, so long as the indicia are visible at the surface. More preferably the promotional indicia are in the form of a redeemable coupon, a proof-of-purchase indicator, or a game token. The promotional indicia can be printed in single or multicolor inks, as desired. The promotional token can also include a holographic image, if desired. Holographic images are typically film laminates having a hologram imbedded within a polymeric film layer. The use of a holographic image can provide security against counterfeiting of the promotional token, which could be useful for promotions involving high value sweepstakes, for example.

Numerous variations and modifications of the embodiments described above may be effected without departing from the spirit and scope of the novel features of the invention. No limitations with respect to the specific embodiments illustrated herein are intended or should be inferred.

We claim:

1. A sealed container comprising: a container body including an access opening surrounded by a finish with a sealant sheet heat-bonded to the finish and covering the opening, and a closure engaged with finish over the sealant sheet, with a promotional token loosely disposed between the sealant sheet and the closure; wherein the sealant sheet includes a heat-sealable surface and a tacking surface, and the promotional token includes a tacking surface and an obverse surface, at least one surface of the promotional token having promotional indicia visible thereon;

the sealant sheet and the promotional token being applied to the finish of the container as an integral sheet material prior to heat-bonding; the integral sheet material comprising the sealant sheet and the promotional token, with the tacking surface of the promotional token being bound to the tacking surface of the sealant sheet by a layer of wax, and at least one of the tacking surface of the promotional token and the tacking surface of the sealant sheet being capable of absorbing a sufficient amount of liquid wax from the layer of wax to cause the promotional token to release from the sealant sheet when the layer of wax is melted, wherein the heat-sealable surface of the sealant sheet is bound to the finish of the container by application of a sufficient amount of heat to fuse the heat-sealable surface to the finish and to melt the layer of wax, and the token is thereby released from the sealant sheet so that the token is loosely disposed between the closure and the sealant sheet such that when the closure is removed from the container, the token remains loose on the sealant sheet.

2. The sealed container of claim 1 wherein at least one of the promotional token and the sealant sheet comprises a layer of metal foil.

3. The sealed container of claim 1 wherein the layer of wax has a melting point in the range of about 65 to about 150° C.

4. The sealed container of claim 1 wherein the tacking surface of the sealant sheet comprises a barrier film.

5. The sealed container of claim 4 wherein tacking surface of the promotional token is a wax-absorbent material.

6. The sealed container of claim 5 wherein the wax-absorbent material is a layer of paper or a layer of synthetic fabric.

7. The sealed container of claim 1 wherein at least one of promotional token and the sealant sheet comprises a layer of aluminum foil.

8. The sealed container of claim 1 wherein the tacking surface of the sealant sheet is a layer of paper or a layer of synthetic fabric.

9. The sealed container of claim 1 wherein the layer of wax comprises microcrystalline wax.

10. The sealed container of claim 1 wherein the obverse surface of the promotional token is a polymer film and the tacking surface of the promotional token is a layer of wax-absorbent material.

11. The sealed container of claim 1 wherein the heat-sealable surface of the sealant sheet is a heat sealable film comprising a polymer selected from the group consisting of medium density polyethylene, polypropylene, ethylene vinyl acetate copolymer, and polyethylene terephthalate.

12. The sealed container of claim 1 wherein the promotional indicia are in the form of a coupon, a proof-of-purchase indicator, or a game token.

13. A sealed container comprising: a container body including an access opening surrounded by a finish with a sealant sheet heat-bonded to the finish and covering opening, and a closure engaged with finish over the sealant sheet, with a promotional token loosely disposed between the sealant sheet and the closure; wherein the sealant sheet includes a heat-sealable surface and a tacking surface, and the promotional token includes a tacking surface and an obverse surface, at least one surface of the promotional token having promotional indicia visible thereon;

at least one of the promotional token and the sealant sheet comprising a layer of aluminum foil;

the sealant sheet and the promotional token being applied to the finish of the container as an integral sheet material prior to heat-bonding; the integral sheet material comprising the sealant sheet and the promotional token, with the tacking surface of the promotional token being bound to the tacking surface of the sealant sheet by a layer of wax, and at least one of the tacking surface of the promotional token and the tacking surface of the sealant sheet comprising a layer of paper or a layer of synthetic fabric, the layer of paper or synthetic fabric being capable of absorbing a sufficient amount of liquid wax from the layer of wax to cause the promotional token to release from the sealant sheet when the layer of wax is melted, the heat-sealable surface of the sealant sheet is bound to the finish of the container by application of a sufficient amount of heat to fuse the heat-sealable surface to the finish and to melt the layer of wax, and the token is thereby released from the sealant sheet and is loosely disposed between the closure and the sealant sheet such that when the closure is removed from the container, the token remains loose on the sealant sheet.

14. The sealed container of claim 13 wherein the tacking surface of the promotional token is a layer of paper.

15. The sealed container of claim 13 wherein the tacking surface of the promotional token is a layer of synthetic fabric.

16. The sealed container of claim 13 wherein the tacking surface of the sealant sheet is a layer of paper.

17. The sealed container of claim 13 wherein the tacking surface of the sealant sheet is a layer of synthetic fabric.

18. The sealed container of claim 13 wherein the tacking surface of the sealant sheet is a barrier film.

19. The sealed container of claim 13 wherein the promotional token comprises a layer of aluminum foil and the sealant sheet is substantially transparent.

* * * * *

UNITED STATES PATENT AND TRADEMARK OFFICE

CERTIFICATE OF CORRECTION

PATENT NO. : 7,713,605 B2
APPLICATION NO. : 11/008495
DATED : May 11, 2010
INVENTOR(S) : Paul E. Yousif et al.

It is certified that error appears in the above-identified patent and that said Letters Patent is hereby corrected as shown below:

Column 1, line 61, delete "i.e..," and insert --(i.e.,)--

Column 2, line 9, delete the word "Modem" and insert --Modern--.

Column 12, line 31, after the word "melted," insert --wherein--.

Signed and Sealed this

Tenth Day of August, 2010

David J. Kappos

David J. Kappos
*Director of the United States Patent and Trademark Office*